US005683301A

United States Patent [19]

Dunn, Jr. et al.

[11] Patent Number: 5,683,301

[45] Date of Patent: Nov. 4, 1997

[54] MOVABLE OCCUPANT DIRECTED RECREATIONAL EQUIPMENT DEVICE

[75] Inventors: James O. Dunn, Jr.; Grant M. Strawcutter; Jonathan E. Brooks, all of Charlotte; Todd A. Coble, Stanfield, all of N.C.

[73] Assignee: Soft Play, L.L.C., Charlotte, N.C.

[21] Appl. No.: 633,662

[22] Filed: Apr. 17, 1996

[51] Int. Cl.[6] ..... A63G 1/16

[52] U.S. Cl. ..... 472/17; 472/130

[58] Field of Search ..... 472/14, 59, 135, 472/130, 17; 434/55, 58

[56] References Cited

U.S. PATENT DOCUMENTS

| | | | |
|---|---|---|---|
| 1,393,456 | 10/1921 | Ruggles | 434/55 X |
| 1,896,175 | 2/1933 | Huffman | 472/130 X |
| 3,164,382 | 1/1965 | Johnson | 472/17 |
| 3,276,777 | 10/1966 | Pruitt, Sr. | 472/17 |
| 3,578,381 | 5/1971 | Young | 297/300 |
| 3,597,857 | 8/1971 | Akister et al. | 434/58 |
| 3,936,140 | 2/1976 | Ahrens | 272/54 |
| 4,379,550 | 4/1983 | Petersen | 272/52 |
| 4,402,500 | 9/1983 | Coles | 434/55 X |
| 4,995,603 | 2/1991 | Reed | 272/18 |
| 5,062,624 | 11/1991 | Reed | 272/1 |

OTHER PUBLICATIONS

Miracle Recreation Equipment Company 1995 Park & Playground Catalog, pp. 79–80.

Soft Play, L.L.C.'s 1995 "Value Series" brochure dated 1995.

*Primary Examiner*—Kien T. Nguyen

*Attorney, Agent, or Firm*—Polster, Lieder, Woodruff & Lucchesi, llc

[57] ABSTRACT

A movable occupant directed recreational equipment device is disclosed. The device includes an enclosure having at least one opening for entry of an occupant and a support for suspending the enclosure above a floor or ground surface. The support and enclosure are constructed to permit movement of the enclosure relative to the support in at least one predetermined path. An occupant directed controller within the enclosure is provided for directing movement of the enclosure relative to the support in the at least one predetermined path. Preferably, the enclosure and support are constructed to permit movement of the support in at least two predetermined paths through a dual axis pivoting mechanism, although additional movement of the enclosure relative to the support is provided in pathways outside of the at least two predetermined paths which are generally transverse to one another. The device may be connected to one or more flexible tubes in a recreational play system environment to enable movement of the enclosure while remaining connected to the tubes.

30 Claims, 5 Drawing Sheets

MOVABLE OCCUPANT DIRECTED RECREATIONAL EQUIPMENT DEVICE

CROSS REFERENCE TO RELATED APPLICATIONS

This is a copending patent application of the following commonly assigned patent applications: Ser. No. 08/633,462, filed Apr. 17, 1996 entitled MULTI-DIRECTIONAL MOVABLE RECREATIONAL EQUIPMENT DEVICE, Ser. No. 08/634,044, filed Apr. 17, 1996 entitled VERTICALLY MOVABLE RECREATIONAL EQUIPMENT DEVICE, Ser. No. 08/633,587, filed Apr. 17, 1996 entitled LATERALLY MOVABLE RECREATIONAL EQUIPMENT DEVICE, and Design patent application Ser. No. 29/055,394, , filed Jun. 5, 1996 entitled MOVING RECREATIONAL EQUIPMENT COMPONENT.

BACKGROUND OF THE INVENTION

Children's outdoor playground or recreational equipment that facilitates movement is quite popular. In addition to swing sets, rotating or whirling devices and teeter-totters, children love to sit on spring mounted riders that have various animal and other shapes. Typically, such spring mounted riders have coil springs or leaf springs that extend between the ground and the rider. As a result, children can sit on the rider and create their own bouncing and rocking movements. Examples of such devices are shown in U.S. Pat. Nos. 3,578,381; 3,836,140; 4,379,550; and in the Miracle Recreation Equipment Company 1995 Park and Playground Catalog at pages 79–80.

Children's indoor playground or recreational equipment does not readily offer various moving type play devices. Space, along with safety, restricts the availability of various types of movable recreational equipment. This is also true of tubular play systems and enclosures through which children crawl or move, such as shown, for example, in Soft Play, L.L.C.'s 1995 "Value Series" brochure. Where an indoor recreational play system includes such tube and junction boxes or other enclosures through which children crawl or move, it would be desirable to provide movement of the junction box, enclosures or other elements. Although children enjoy being confined in a mirage or tubes and enclosures in such tubular play equipment, in order to create a more interesting environment, it has been discovered that it is possible to provide for movement of the enclosures or other elements, while enabling such elements to remain connected to generally flexible components in the tubular play equipment.

There are some rotating and tilting enclosures which are separate, free standing devices, including for example, U.S. Pat. Nos. 4,995,603 and 5,062,624. However, when enclosures are part of a recreational play system that includes connected tubes and enclosures, it would be particularly desirable to provide for movement of the enclosures or other elements, while enabling same to remain connected to generally non-moving tubes or other components in the tubular play equipment.

In all of the aforementioned copending patent applications, the recreational equipment device is vertically or laterally or multi-directional movable based on the weight or movement of the occupant within the enclosure. The present invention, on the other hand, relates to a movable occupant directed recreational equipment device in the sense that movement is directed by the occupant by engaging, for example, a hand operated occupant controller which causes the desired movement in one or a plurality of different paths.

SUMMARY OF THE INVENTION

Accordingly, among the several objects and advantages of the present invention include:

- The provision of a movable occupant directed recreational equipment device;
- The provision of the aforementioned movable occupant directed recreational equipment device which allows for movement of the device while remaining connected to various generally flexible tubular elements or other parts in a tubular play equipment system;
- The provision of the aforementioned movable occupant directed recreational equipment device which provides for movement of the device while being suspended relative to a support;
- The provision of the aforementioned movable occupant directed recreational equipment device in which an occupant causes movement of the device through a hand operated controller or the like;
- The provision of the aforementioned movable occupant directed recreational equipment device which provides occupant directed movement in at least two paths that are generally transverse to one another;
- The provision of the aforementioned movable occupant directed recreational equipment device which provides controlled multi-directional movements;
- The provision of the aforementioned movable occupant directed recreational equipment device which can be quickly and economically manufactured; is easy to use and maintain; is made of a minimum number of pans, is safe in operation; and is otherwise well adapted for the purposes intended.

Briefly stated, the movable occupant directed recreational equipment device of the present invention includes an enclosure having at least one opening for entry of an occupant. A support suspends the enclosure above a floor or ground surface. The support and enclosure are constructed to permit movement of the enclosure relative to the support in at least one predetermined path. An occupant directed controller is provided within the enclosure for directing movement of the enclosure relative to the support in the at least one predetermined path.

The enclosure and support are preferably constructed to permit movement of the enclosure relative to the support in at least two predetermined paths, one of such paths extending generally transverse to the other path. The enclosure and support may be constructed to permit movement of the support in a plurality of paths, including a full range of paths that provides universal movement of the enclosure relative to the support.

Preferably, the enclosure is pivotally mounted to the support for a limited range of movement in at least one predetermined path. For this purpose, the enclosure is pivotally mounted to the support in at least two opposed positions of the enclosure. The enclosure may also be pivotally mounted to the support in two pairs of opposed positions, one pair of opposed positions being generally transverse to the other pair of opposed positions. In such a case, the enclosure may be mounted to the support through a dual axis pivoting mechanism.

The occupant directed controller is preferably hand operated to facilitate movement of the enclosure relative to the support in the pathway directed by the occupant.

To facilitate movement of the enclosure while enabling the enclosure to remain connected to a tubular element that is part of a tubular play system, the tube that connects the enclosure to the play system is flexible to accommodate the movement of the enclosure. One or more flexible tubes may be connected to the enclosure in the tubular play system environment, if desired.

The dual axis pivoting mechanism includes first and second axes which extend transverse to one another. The specific construction of the dual axis pivoting mechanism includes an oblong configuration with first and second transversely extending axes that are mounted along the major and minor axes of the oblong configuration. Such oblong configuration includes a first oblong ring that is fixed to the support and a second oblong ring that extends within and is pivotally mounted along one axis to the first oblong ring while also being pivotally mounted along a second axis to the enclosure that extends within the second oblong ring.

These and other objects and advantages of the present invention will become apparent from the description that follows.

BRIEF DESCRIPTION OF THE DRAWINGS

In the drawings.

Corresponding reference numerals will be used throughout the several figures of the drawings.

DESCRIPTION OF THE PREFERRED EMBODIMENTS

The following detailed description illustrates the invention by way of example and not by way limitation. This description will clearly enable one skilled in the an to make and use the invention, and describes several embodiments, adaptions, variations, alternatives and uses of the invention, including what I presently believe is the best mode of carrying out the invention.

Figure 11:
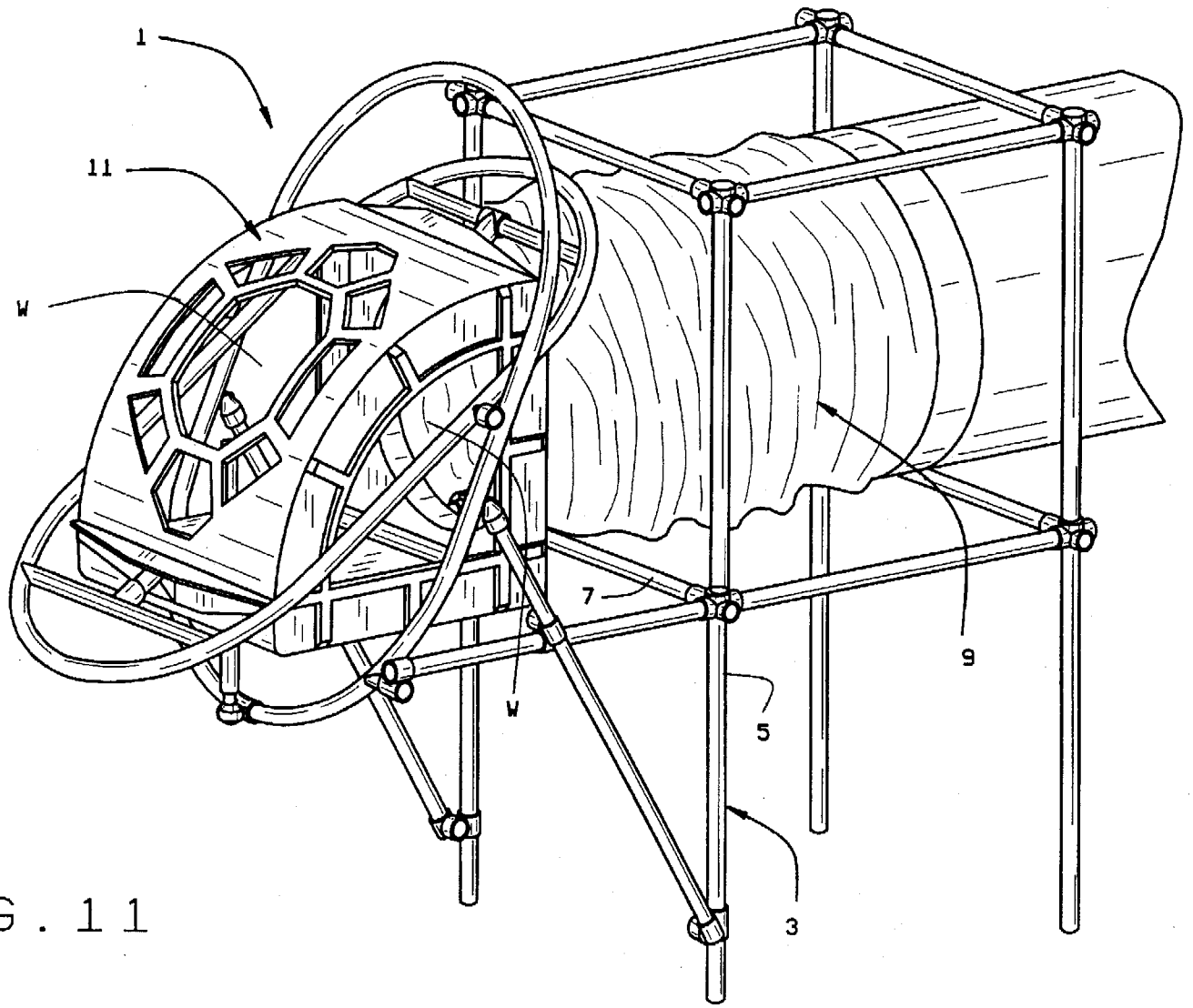
FIG. 11 is a perspective view of a typical tubular play system environment which includes the movable occupant directed recreational equipment device of the present invention.

In order to understand a typical and preferred tubular recreational play system in which the movable occupant directed recreational equipment device of the present invention may be used, reference is first made to FIG. 11 of the drawing.

As illustrated in FIG. 11, a recreational play system 1 may include a supporting structure 3 having a series of interconnected vertical struts 5 and horizontal struts 7 for supporting an interconnected tubular and enclosure play structure. The interconnected tubular and enclosure play structure may include the interconnected tube 9 and enclosure 11 which may be arranged in any desired location and at various respective heights in the supporting structure 3, as may be desired. The interconnected tube 9 and enclosure 11 enable children to crawl or move through the tubular play system for a fun play experience. It will be understood that the enclosure 11 may be connected to one or more tubes 9 and may include the use of transparent windows W, as illustrated in FIG. 11.

Typically, the enclosure 11 shown in FIG. 11, as well as the other enclosures shown in the above identified co-pending patent applications, have been static structures in that they have been attached in a fixed position to the vertical struts 5 and/or horizontal struts 7. However, it has been discovered that it is possible to construct suspended enclosures in order to provide movement of the enclosures in one or more directions, in order to enhance the play experience of the children when entering the enclosures. At the same time, the enclosures remain connected to the tubular play system 1. In this regard, in order to facilitate the desired movement of the enclosure relative to the support, as discussed in detail below, the tube 9 is preferably a flexible tube for connecting the enclosure 11 to the remaining tubular elements and enclosures of the tubular play system 1. For example, the flexible tube 9 may be formed from a webbing type material that permits considerable movement of the tube 9, while remaining connect to the enclosure 11 as well as the other components of the tubular play system 1.

In the aforementioned co-pending patent applications, the enclosures are described as being movable relative to the support by a controlled fluid or resilient movement in one or more directions. For the purpose, resilient devices such as springs or other shock absorbing elements, for example, were used to permit safe and controlled fluid or resilient movement of the enclosures relative to their respective supports. Thus, the recreational equipment devices in such aforementioned co-pending patent applications were vertically or laterally or multidirectional movable based upon the weight or movement of the occupant within the enclosure.

As distinct from such aforementioned structure, the present invention provides a movable occupant directed recreational equipment device 13 in the sense that movement is directed by the occupant by engaging, for example, a hand operated occupant controller which causes the desired movement of the enclosure 11 in one or a plurality of different paths, as may be desired.

The movable occupant directed recreational equipment device 13 of the present invention is best illustrated in FIGS. 1–10 of the drawings and includes the enclosure 11 which is constructed as a generally quarter cylindrical hollow box shape that is roto-molded from suitable plastic material such as polyethylene. As disclosed in U.S. Pat. No. 5,387,165 and co-pending patent application Ser. No. 08/659,176 filed Jun. 5, 1996 entitled IMPROVED RECREATIONAL EQUIPMENT JUNCTION BOX, the generally quarter cylindrical hollow box shaped enclosure 11 may be modified and configured in various ways to include a different number and location of connected tubes, windows and ventilator panels, as my be desired. Additionally, the generally quarter cylindrical hollow box shape 11 illustrated in the drawings may include a noncurvilinear shape, as long as the overall configuration appears to have the general shape of quarter section of what would otherwise be a cylindrical or other corresponding or equivalent shape, as will be understood.

For purposes of the present invention, the enclosure 11 may have any desired shape, as long as it has one opening 15 for connection to the flexible tube 9. In this regard, the opening 15 in the enclosure 11 may be surrounded by an integral or attached connective tubular neck 17 to facilitate connection to the flexible tube 9. Depending on the shape and construction of the enclosure 11, one or more openings 15 with connective tubular necks 17 may be provided for connection to a corresponding number of flexible tubes 9, in the tubular play system 1 illustrated in FIG. 9 of the drawings.

The movable occupant directed recreational equipment device 13 may be used by itself, as illustrated in FIGS. 1–10 of the drawings; however, preferably it is part of the tubular recreational play system 1 as illustrated in the FIG. 11 of the drawings.

The movable occupant directed recreational equipment device 13 further includes a support 19 for suspending the enclosure 11 above a floor or ground surface. The support 19 includes spaced vertical struts 21, 21 that are interconnected to one another through a strut connector C that is connected to a horizontal strut 23 at an upper end of the spaced vertical struts 21, 21. A second set of horizontal struts 23, 23, also connected to the strut connector C, extend transversely from the first horizontal strut 23 on opposite sides of the enclosure 11, as best seen in FIGS. 1 and 4–6 of the drawings. A spaced pair of angular struts 25, 25 are connected to different strut connector C at a lower end of the base vertical struts 21, 21, while also being interconnected to the spaced pair of horizontal struts 23, 23 on each side of the enclosure 11, through another strut connector C. As will be appreciated, the strut connector C can be constructed to interconnect two or three struts, as may be desired. In addition, other common methods of securing the struts together may be used, if desired.

Each of the angular struts 25 also extend beyond the horizontal strut 23 to which it is connected for interconnection to an angularly offset first or outer oblong ring 27 that is fixed to both the angular strut 25 as well as an outer end of each horizontal strut 23 on opposite sides of the enclosure 11 at the strut connectors C, as illustrated. Thus, the first or fixed oblong ring 27 is fixed to the strut connectors C at the outer end of each of the spaced angular struts 25, 25 as well as to the spaced horizontal struts 23, 23 on each side of the enclosure 11. In this way, the first or fixed oblong ring 27 forms an integral part of the support 19 that suspends the enclosure 11 above a floor or ground surface. At the same time, the angularly offset fixed oblong ring 27 permits movement of the enclosure 11 relative to the fixed oblong ring 27, as will now be discussed.

Figure 4:
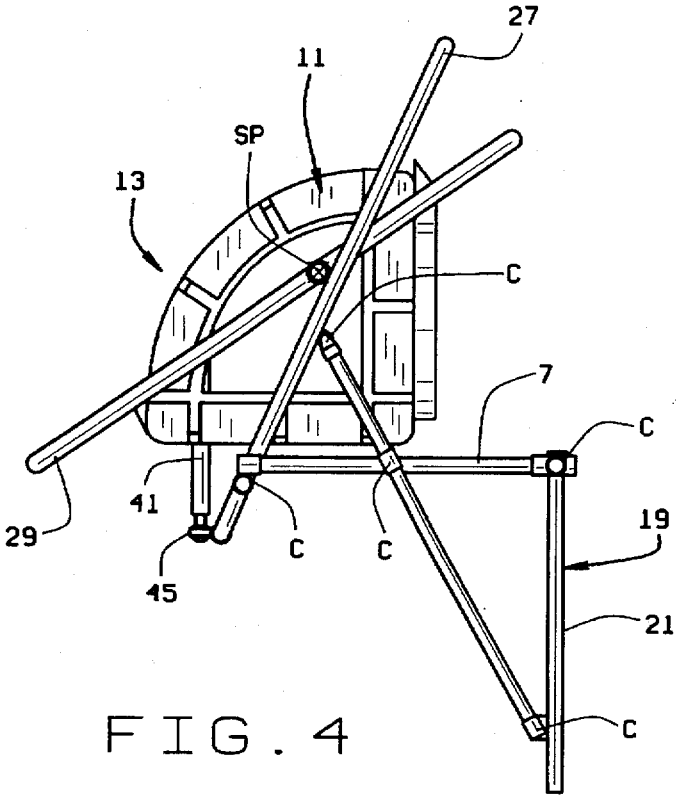
FIG. 4 is a side elevational view of the movable occupant directed recreational equipment device.
Figure 5:
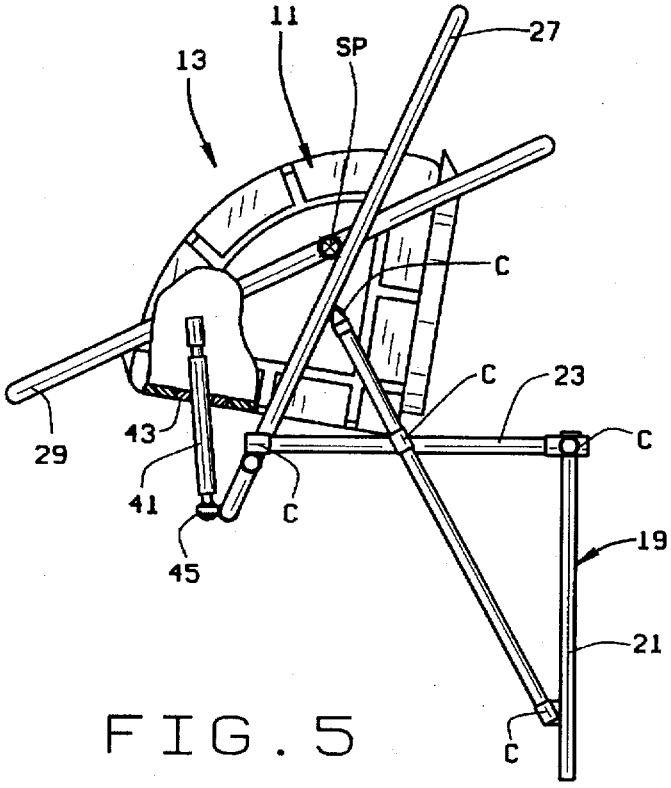
FIG. 5 is a side elevational view, partly in section, of the movable occupant directed recreational equipment device when moved to a rearward position.
Figure 7:
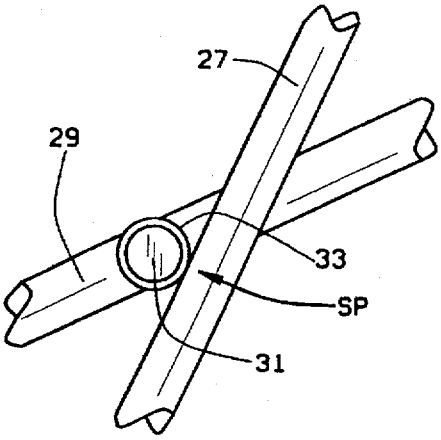
FIG. 7 is an enlarged fragmentary side elevational view of one of the side pivots used in the movable occupant directed recreational equipment device.

Within the first or fixed oblong ring 27 is a second or movable oblong ring 29 that is pivotally mounted to the first or fixed oblong ring 27 at side pivot points SP. For this purpose, the inner or movable oblong ring 19 is preferably provided with a cylindrical pivot 31 that is captured within a cylindrical sleeve or hinge 33 attached to the first or fixed oblong ring 27, as best illustrated in FIG. 7 of the drawings. It will be noted, as best seen in FIGS. 4–5 and 7, that the side pivots points SP are off center rear positioned pivots that facilitate maximum upward and downward movement of the enclosure 11 relative to the support 19, while still maintaining connection of the enclosure 11 to the flexible tube 9. This will be described further below.

The spaced pair of side pivots SP, SP, connecting the first or fixed oblong ring 27 to the movable or second oblong ring 29, enables movement of the enclosure 11 and movable oblong ring 29 relative to the fixed oblong ring 27, as will be described below in connection with FIGS. 5–6 of the drawings.

Figure 1:
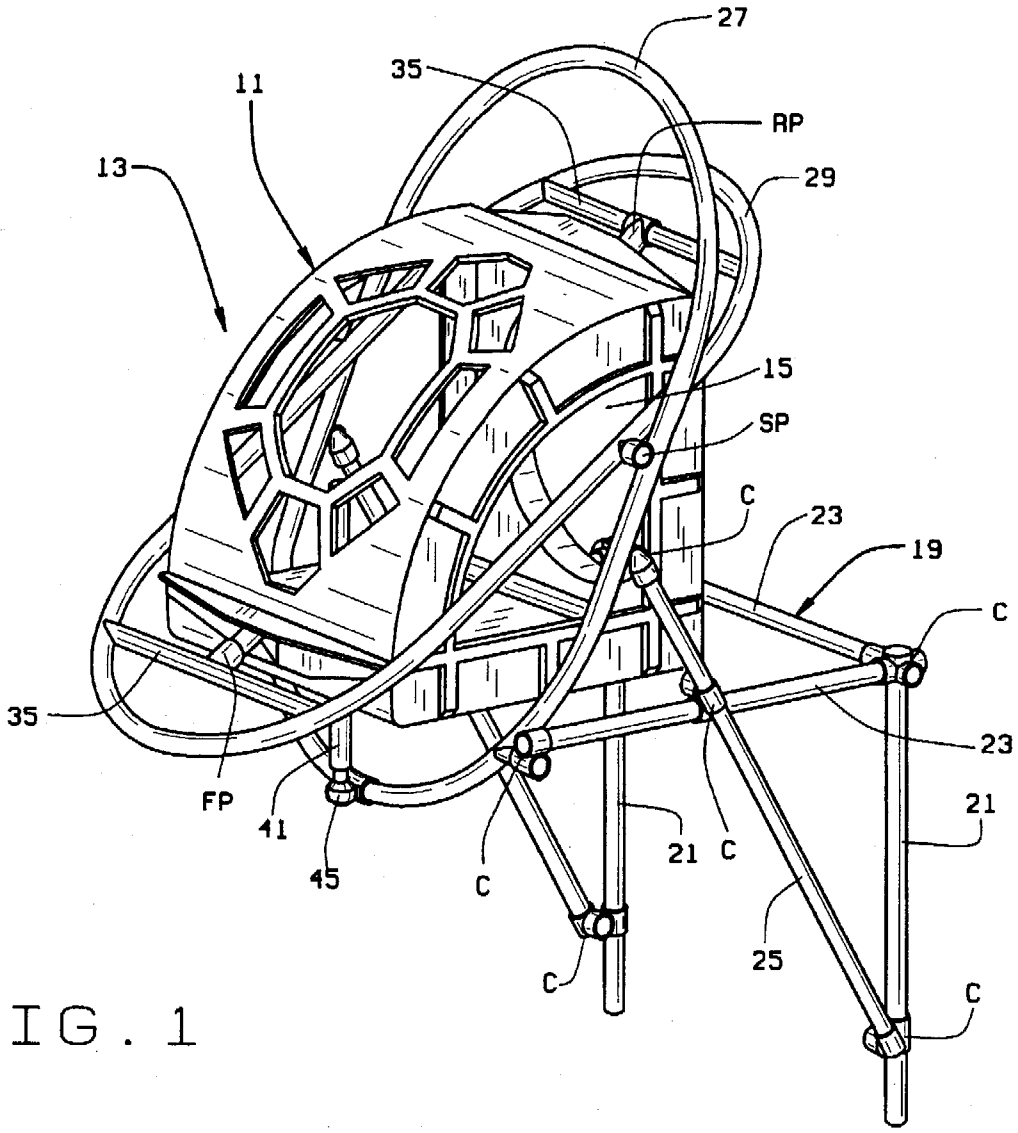
FIG. 1 is a front perspective view of the movable occupant directed recreational equipment device of the present invention.
Figure 2:
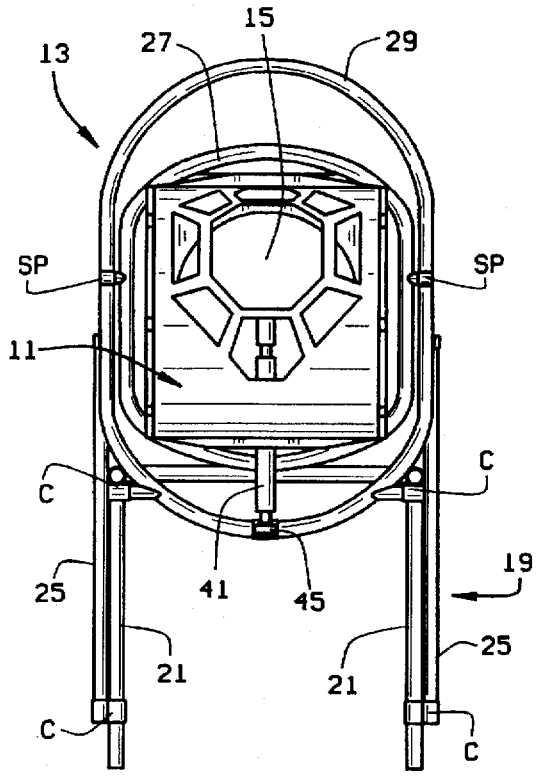
FIG. 2 is a front elevational view of the movable occupant directed recreational equipment device.
Figure 3:
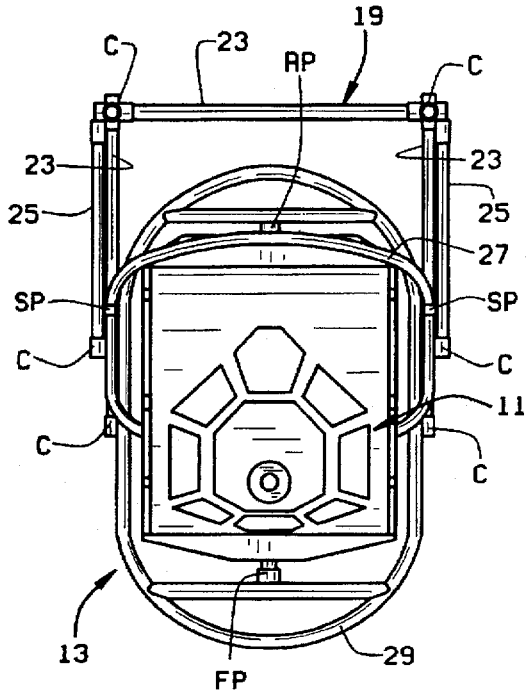
FIG. 3 is a top plan view of the movable occupant directed recreational equipment device.
Figure 10:
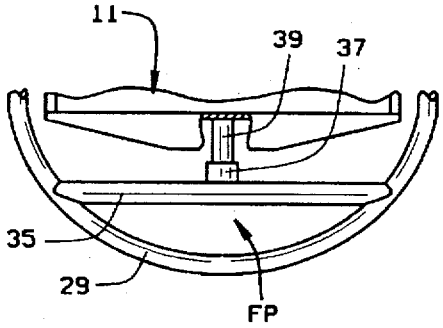
FIG. 10 is an enlarged fragmentary front elevational view of the construction of a front pivot used in the movable occupant directed recreational equipment device of the present invention.

In addition to the spaced pair of side pivots SP, SP pivotally connecting the first or fixed oblong ring 27 to the second or movable oblong ring 29, the movable oblong ring 29 is also connected to the enclosure 11 through spaced front and rear pivots FP, RP, respectively. As best seen in FIGS. 1 and 10 of the drawings, an inner transverse strut 35 extends across the inner or movable oblong ring 29 at each end and a cylindrical collar or sleeve 37 is attached at the midpoint to each of the inner transverse struts 35. The cylindrical collar or sleeve 37 serves as a bushing for the tube 39 that is fixed to the enclosure 11 at opposite ends so as to be pivotally or rotatably mounted within each of the cylindrical collars or sleeves 37 at opposite ends of the enclosure 11.

Through this construction, the inner or movable oblong ring 19 is connected to the enclosure 11 through the spaced tubes 39, 39 which are also received within the cylindrical collars or sleeves 37, 37 to provide a front pivot FP and a rear pivot RP for the enclosure 11 relative to the second or movable oblong ring 29.

In order to provide occupant directed movement of the enclosure 11 relative to the support 19, the movable occupant directed recreational equipment device 13 of the present invention includes a controller 41 which extends upwardly through an opening in the floor 43 of the enclosure, as best seen in FIGS. 5–6 and 8–9 of the drawings. The controller 41 also extends below the enclosure 11 and is connected, through a ball joint pivot 45, to the first or fixed outer oblong ring 27, generally along the midpoint of the first or fixed outer ring 27 in its lowermost curved area, as illustrated throughout several of the figures of the drawings.

The occupant directed controller 41 causes rearward and forward movement of the enclosure 11 about the side pivots SP, SP while providing sideways movement of the enclosure 11 through the front and rear pivots FP, RP. It will also be appreciated that the controller 41 may be moved in any path between the forward and rearward and sideways movement of the enclosure 11 to provide rocking movement of the enclosure 11 relative to the support 19, all of which will now be described.

Figure 6:
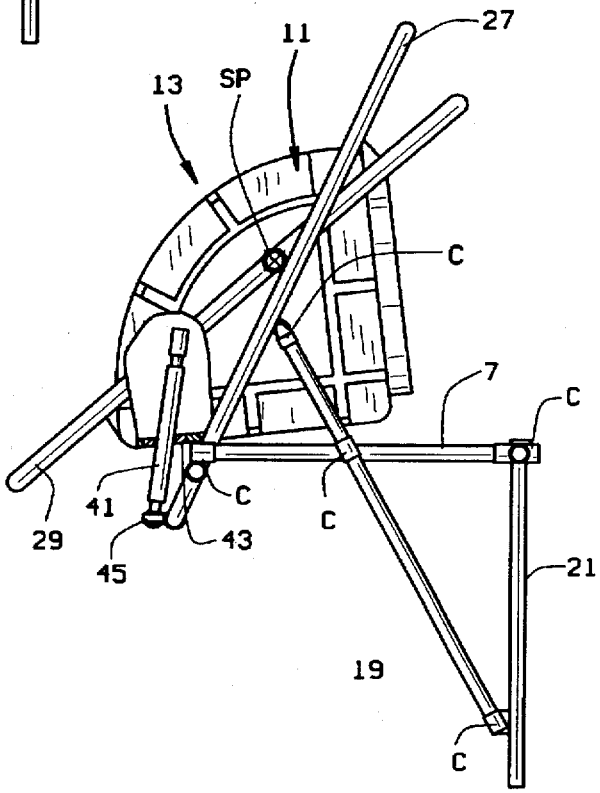
FIG. 6 is a side elevational view, partly in section, of the movable occupant directed recreational equipment device when moved to a forward position.

Referring first to the rearward and forward movement of the enclosure 11 relative to the support 19 as best seen in FIGS. 5–6 of the drawings, the rearward movement of the enclosure 11 is shown in FIG. 5 while the forward movement of the enclosure 11 is shown in FIG. 6. These different positions should be compared to the fixed or static position of the enclosure 11 relative to the support 19 as shown in FIG. 4. In order to cause the rearward movement of the enclosure 11 relative to the support 19, the controller 41 is shown in FIG. 5 as being moved forwardly for engaging the bottom or floor surface 43 of the enclosure 11 to cause the enclosure 11 to be pivoted about the spaced side pivots SP. As compared to FIG. 4, the inner or moving oblong ring 29, along with the enclosure 11, is moved about the spaced pair of side pivots SP, SP. During such movement, the controller 41, by engaging the bottom or floor surface 43 of the enclosure 11, causes the inner or movable oblong ring 29 to be moved in a clockwise position relative to the outer or fixed oblong ring 27.

Forward movement of the enclosure 11 is shown in FIG. 6 of the drawings, and the controller 41 engages the bottom or floor surface 43 of the enclosure 11 at a different height, as compared to that illustrated in FIG. 5 of the drawings. This is due to the fact that the rearward movement of the controller 41, when engaged with the bottom or floor surface 43 of the enclosure 11, moves the inner or movable oblong ring 29 about the spaced side pivots SP, SP in a counterclockwise movement relative to the outer or fixed oblong ring 27. This causes the forward movement of the enclosure 11 as shown in FIG. 6, as compared to the rearward movement of the enclosure 11 shown in FIG. 5.

Repeated forward and rearward movement of the controller 41 by an occupant causes corresponding rearward and forward movement of the enclosure 11, as may be desired by the occupant through manipulation of the controller 41. The off center rear positioned side pivots SP facilitate maximum upward and downward movement of the enclosure 11 relative to the fixed ring 27 since the arc or range of movement of the enclosure 11, in front of the side pivots SP, is enlarged. At the same time, minimum upward and downward movement of the enclosure 11, behind the side pivots SP, is maintained so as to enable the flexible tube 9 to remain attached to the enclosure 11 during such movement.

Figure 8:
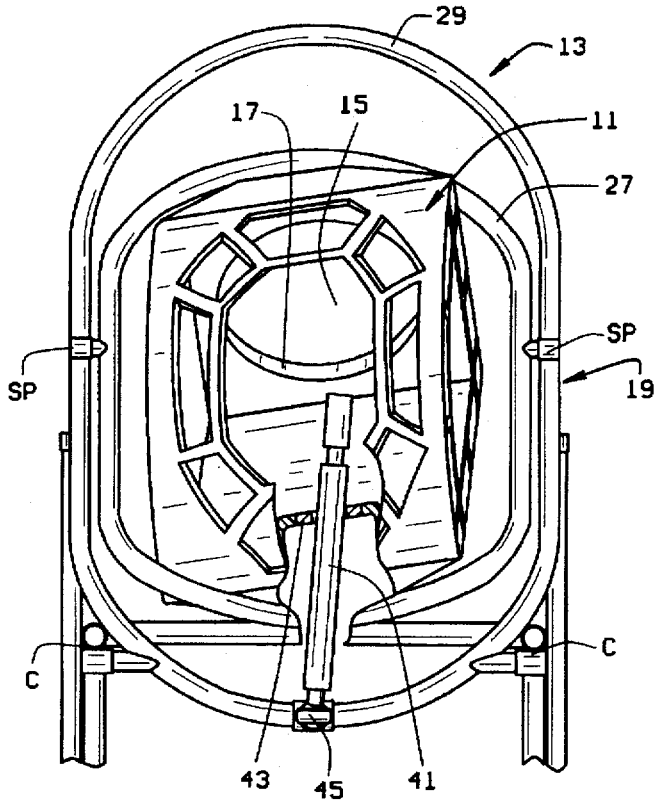
FIG. 8 is a front elevational view, partly in section, of the movable occupant directed recreational equipment device when moved to a leftmost position.
Figure 9:
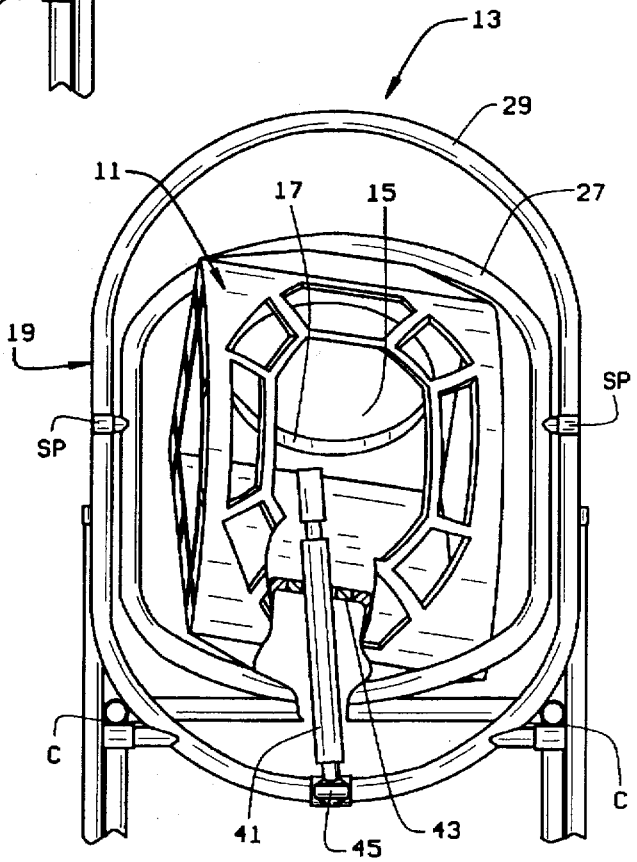
FIG. 9 is a side elevational view, partly in section, of the movable occupant directed recreational equipment device when moved to a rightmost position.

In addition to the rearward and forward movement of the enclosure 11 as shown in FIGS. 5 and 6 of the drawings, the enclosure 11 may be also moved sideways to the left or to the right, as illustrated in FIGS. 8 and 9 of the drawings.

In FIG. 8 of the drawings, the controller 41 is shown as being moved to the right causing the bottom or floor surface 43 of the enclosure 11 to move the enclosure 11 about the front and rear pivots FP, RP through the rotation of the respective tubes 39 in the collars or sleeves 37 of the inner or movable oblong ring 29. As will be appreciated, the ball pivot or universal pivot 45, that connects the controller 41 to the outer or fixed oblong ring 27, enables the enclosure 11, with its fixedly connected tubes 39, 39 to be pivoted about the cylindrical collars or sleeves 37, 37 of the front and rear pivots FP, RP in the inner or movable oblong ring 29. When this occurs, the inner or movable oblong ring 29 does not move relative to the outer of fixed oblong ring 27, as long as the movement of the controller 41 is in a lateral or sideways movement. Thus, in FIG. 9 of the drawings, the controller 41 is shown as engaging the bottom or floor surface 43 of the enclosure 11, causing the enclosure 11 to be pivoted about the front and rear pivots FP, RP and causing the enclosure 11 to be moved to the right.

In both the rearward or forward movement of FIGS. 5 and 6 and left or right movement of the enclosure 11 in FIGS. 8 and 9, the controller 41 is always moved in an opposite direction to the movement of the enclosure 11. Thus, in FIG. 5, the forward movement of the controller 41 causes rearward movement of the enclosure 11 while the rearward movement of the controller 41 in FIG. 6 causes forward movement of the enclosure 11. Similarly, in FIGS. 8 and 9, the rightward movement of the controller 41 in FIG. 8 causes the enclosure 11 to be moved to the left while the leftward movement of the controller 41 in FIG. 9 causes the enclosure 11 to be moved to the right. This, of course, is due to the engagement of the controller with the bottom or floor surface 43 of the enclosure 11 and the cooperative pivotal movement with the respective side pivots SP, SP as shown in FIGS. 5 and 6 and the forward and rearward pivots FP, RP as shown in FIGS. 8 and 9 of the drawings.

It will be understood that the controller 41 can be moved in any angular path between a front and rear movement and a left or right sideways movement. Thus, if the controller 41 is moved in an angular path between such paths or directions, the enclosure 11 will tend to rock in such angular or intermediate positions, as compared to a direct rearward or forward movement as shown in FIGS. 5 and 6 or a lateral or sideways movement as shown in FIGS. 8 and 9.

In order to accommodate movement of the enclosure 11 relative to the support 19, while remaining connected to a tubular play system 1 as shown in FIG. 11 of the drawings, the tube 9 shown in FIG. 11 of the drawings is illustrated as being a flexible tube, i.e., it is made from a webbing material. Alternatively, the tube can be constructed as a flexible tube, if desired. In either case, such flexible tube will accommodate movement of the enclosure 11 while remaining connected to the other components in the tubular play system 1 shown in FIG. 11 of the drawings.

From the foregoing, it will now be appreciated that the movable occupant directed recreational equipment device of the present invention, whether used independently or in conjunction with the recreational play illustrated in FIG. 11 of the drawings, provides occupant directed movement of the enclosure 11 relative to the support 19 in a rearward or forward direction or in opposed lateral directions or in pathways intermediate such directions. Where such pathways are intermediate, the enclosure 11 will be afforded a rocking movement, as compared to a direct rearward or forward movement or opposed lateral or sideways movement of the enclosure 17. Movement of the enclosure 17 is also accomplished without separation from the other components in a recreational play system environment.

In view of the above, it will be seen that the several objects and advantages of the present invention have been achieved and other advantageous results have been obtained.

As various changes could be made in the above constructions without departing from the scope of the invention, it is intended that all matter contained in the above description or shown in the accompanying drawings shall be interpreted as illustrative and not in a limiting sense.

We claim:

1. A movable occupant directed recreational equipment device, including:

an enclosure having at least one opening for entry of an occupant;

a support for suspending the enclosure above a floor surface;

said enclosure and support being constructed to permit movement of the enclosure relative to the support in at least one predetermined path and including at east one ring surrounding the enclosure and extending between the enclosure and support;

the at least one ring being pivotally mounted to the enclosure through off center rear positioned pivots to facilitate movement in the at least one predetermined path.

2. The device as defined in claim 1 in which the enclosure and support are constructed to permit movement of the enclosure in at least two predetermined paths and includes first and second rings surrounding the enclosure and extending between the enclosure and support, one ring being fixed to the support while pivotally mounting the other ring and enclosure for movement in at least one predetermined path.

3. The device as defined in claim 2 in which the predetermined paths are generally transverse to one another.

4. The device as defined in claim 2 in which the other ring pivotally mounts the enclosure for movement in the second predetermined path.

5. The device as defined in claim 4 in which the enclosure is mounted to the support for movement in a plurality of different paths that includes a full range of paths providing universal movement of the enclosure relative to the support.

6. The device as defined in claim 2 in which the enclosure is pivotally mounted to the at least one ring in first opposed positions of the enclosure.

7. The device as defined in claim 6 in which the enclosure is pivotally mounted to the other ring in second opposed positions of the enclosure which are generally transverse to the first opposed positions.

8. The device as defined in claim 1 in which the enclosure is pivotally mounted to the support in two pairs of opposed positions of the enclosure, one pair of the opposed positions being generally transverse to the other pair of opposed positions.

9. The device as defined in claim 1 in which the at least one ring is mounted in an angularly offset position relative to the support and enclosure to facilitate attachment of the at least one ring to the support while permitting movement of the enclosure relative to the at least one ring.

10. The device as defined in claim 1 in which the enclosure is moved by a hand operated occupant directed controller.

11. The device a defined in claim 1 in which a flexible tube is connected to the opening in the enclosure in a series of interconnected tubes forming a tubular recreational play system, said flexible tube remaining connected to the enclosure during movement of the enclosure.

12. The device as defined in claim 10 in which the enclosure and support are connected to each other and to the hand occupant directed controller to facilitate universal movement of the enclosure.

13. A movable occupant directed movable recreational equipment device in a tubular recreational system, including:

an enclosure having at least one opening for entry of an occupant;

a support for suspending the enclosure above a floor surface;

said enclosure being pivotally mounted to the support in two pairs of opposed positions relative to the enclosure, one pair of opposed positions being generally transverse to the other pair of opposed positions for movement in at least two predetermined paths;

an occupant directed controller within the enclosure for directing movement of the enclosure relative to the support in the at least two predetermined paths; and a complementary shaped flexible tubular element connected at one end to the opening of the enclosure and connected at an opposite end to a series of tubes forming a tubular recreational play system.

14. The device as defined in claim 13 in which the occupant directed controller is hand operated.

15. The device as defined in claim 13 in which the enclosure and support are connected to each other and to the occupant directed controller to facilitate universal movement of the enclosure.

16. A movable occupant directed recreational equipment device, including:

an enclosure having at least one opening for entry of an occupant;

a support for suspending the enclosure above a floor surface;

a dual axis pivoting mechanism having a limited range of movement that connects the enclosure relative to the support, the dual axis pivoting mechanism having first and second axes which extend generally transverse to one another; and an occupant activated controller within the enclosure that is connected to the dual axis pivoting mechanism for directing the limited range of movement of the enclosure relative to the support about the dual axis pivoting mechanism in two predetermined directions.

17. The device as defined in claim 16 including a first oblong ring fixed to the support and a second oblong ring extending within and pivotally mounted along one axis to the first oblong ring while also being pivotally mounted along a second axis to the enclosure that extends within the second oblong ring.

18. A movable occupant directed recreational equipment device, including:

an enclosure having at least one opening for entry of an occupant;

a support for suspending the enclosure above a floor surface;

a first oblong ring fixed to the support;

a second oblong ring extending within and pivotally mounted on opposite sides to the first oblong ring along a first predetermined axis;

the enclosure extending within and being pivotally mounted on opposite sides to the first oblong ring along a second predetermined axis that is generally transverse to the first predetermined axis; and a hand operated occupant directed controller within the enclosure that is connected by a universal pivot to the first oblong ring for moving the enclosure and second oblong ring relative to the first oblong ring about the first predetermined axis as well as moving the enclosure relative to the second oblong ring about the second predetermined axis.

19. A movable occupant directed recreational equipment device, including:

an enclosure having at least one opening for entry of an occupant;

a support for suspending the enclosure above a floor surface;

said enclosure and support being constructed to permit a limited range of movement of the enclosure relative to the support in at least two predetermined paths;

the enclosure being pivotally mounted to the support in two pairs of opposed positions of the enclosure, one pair of opposed positions being generally transverse to the other pair of opposed positions; and first and second rings surrounding the enclosure and extending between the enclosure and support, one ring being fixed to the support while pivotally supporting the other ring and enclosure for a limited range of movement in at least one predetermined path, at least the one fixed ring being mounted in an angularly offset position relative to the support and enclosure.

20. The device as defined in claim 19 in which the other ring pivotally mounts the enclosure for a limited range of movement in the second predetermined path.

21. The device as defined in claim 20 in which the enclosure is moved by a hand operated occupant directed controller that is connected to the other ring.

22. The device as defined in claim 21 in which the enclosure and support are constructed to permit a limited range of movement of the enclosure in at least two predetermined paths.

23. The device as defined in claim 22 in which the enclosure and support are constructed to permit a limited range of movement of the support in a plurality of different paths.

24. The device as defined in claim 21 and including a hand operated occupant directed controller for moving the enclosure.

25. A movable occupant directed recreational equipment device, including:

an enclosure having at least one opening for entry of an occupant;

a support for suspending the enclosure above a floor surface;

said enclosure and support being constructed to permit a limited range of movement of the enclosure relative to the support in at least one predetermined path and including first and second rings surrounding the enclosure and extending between the enclosure and support;

one ring being fixed to the support while pivotally mounting the other ring and enclosure on opposite sides of the enclosure for the limited range of movement in the at least one predetermined path, at least the one fixed ring being mounted in an angularly offset position relative to the support and enclosure.

26. The device as defined in claim 25 in which the predetermined paths are generally transverse to one another.

27. A movable occupant directed recreational equipment device, including:

an enclosure having at least one opening for entry of an occupant;

a support for suspending the enclosure above a floor surface;

a limited movement dual axis pivoting mechanism providing a limited range of movement of the enclosure relative to the support in at least two predetermined paths, the limited movement dual axis pivoting mechanism connected to at least one angularly offset ring extending between the enclosure and support and pivotally connecting the enclosure in two pairs of opposed positions of the enclosure, one pair of the opposed positions being generally transverse to the other pair of opposed positions.

28. The device as defined in claim 27 in which the dual axis pivoting mechanism has first and second axes which extend transverse to one another.

29. The device as defined in claim 28 including a first oblong ring fixed to the support and a second oblong ring extending within and pivotally mounted along one axis to the first oblong ring while also being pivotally mounted along a second axis to the enclosure that extends within the second oblong ring.

30. A movable occupant directed recreational equipment device, including:

an enclosure having at least one opening for entry of an occupant;

a support for suspending the enclosure above a floor surface;

a first ring fixed to the support;

a second ring extending within and pivotally mounted on opposite sides to the first ring along a first predetermined axis;

the enclosure extending within and being pivotally mounted on opposite sides to the first ring along a second predetermined axis that is generally transverse to the first predetermined axis; and a hand operated occupant directed controller within the enclosure that is connected by a universal pivot to the first ring for moving the enclosure and second ring relative to the first ring about the first predetermined axis as well as moving the enclosure relative to the second ring about the second predetermined axis.

* * * * *

UNITED STATES PATENT AND TRADEMARK OFFICE

CERTIFICATE OF CORRECTION

PATENT NO. : 5,683,301

DATED : November 4, 1997

INVENTOR(S) : James O'Dunn, et. al.

It is certified that error appears in the above-indentified patent and that said Letters Patent is hereby corrected as shown below:

Column 9, Line 32
insert after "hand" -operated-

Signed and Sealed this

Twenty-eighth Day of July, 1998

*Attest:*

Bruce Lehman

BRUCE LEHMAN

*Attesting Officer*

*Commissioner of Patents and Trademarks*